United States Patent [19]

Rogers

[11] Patent Number: 4,566,605

[45] Date of Patent: Jan. 28, 1986

[54] LID FOR DRINKS CONTAINER

[75] Inventor: J. David Rogers, Toronto, Canada

[73] Assignee: Amhil Enterprises Ltd., Mississauga, Canada

[21] Appl. No.: 754,164

[22] Filed: Jul. 12, 1985

[51] Int. Cl.[4] ..... A47G 19/22; B65D 41/26

[52] U.S. Cl. ..... 220/90.2; 220/90.4; 229/7 R

[58] Field of Search ..... 220/90.2, 90.4, 90.6, 220/85 SP, 265, 266; 206/508; 229/7 R

[56] References Cited

U.S. PATENT DOCUMENTS

| | | | |
|---|---|---|---|
| 4,056,210 | 11/1977 | Boyle | 229/7 R X |
| 4,106,660 | 8/1978 | Boyle | 220/90.4 |
| 4,184,604 | 1/1980 | Amberg et al. | 220/90.4 X |
| 4,186,842 | 2/1980 | Albert | 220/90.4 X |
| 4,202,459 | 5/1980 | De Parales et al. | 229/7 R X |
| 4,245,752 | 1/1981 | Prueher | 220/90.4 X |
| 4,350,260 | 9/1982 | Prueher | 229/7 R X |
| 4,438,865 | 3/1984 | Scattaregia | 220/90.2 X |
| 4,489,848 | 12/1984 | Braude | 220/90.4 |

*Primary Examiner*—Steven M. Pollard

*Attorney, Agent, or Firm*—Donald E. Hewson

[57] ABSTRACT

The vacuum-formed plastic lid for a large disposable container of liquids includes a pouring spout formed into the rim of the lid. A portion of the lid can be torn out, and the liquid poured through the hole. A well in the lid constitutes a receptacle for storing and carrying a number of empty, smaller, drinking cups. The lid includes a ridge, and two cuts, one either side of the ridge. When a person squeezes the ridge, the cuts spread over the ridge, until they meet. The ridge constitutes also a handle, by which the person can manipulate and remove the tear-out portion.

13 Claims, 2 Drawing Figures

LID FOR DRINKS CONTAINER

This invention is in the field of drinks containers of the disposable kind. Such containers are made typically of waxed paper or polystyrene or other suitable materials.

Because of the difficulty a person experiences in carrying several drinking cups full of liquid, even when the cups have lids, it is desirable to supply the liquid in a single large container. Such a container may have its own lid, and the several (small) drinking cups may then be empty when they are being carried. Thus, by the use of a large container a person at a sporting event for example may carry drinks for several people back to his seat without difficulty. Furthermore, a vendor can dispense the liquid into the large container more quickly and more easily than into several small cups.

The invention relates to the construction of the lid for the large container. The invention is concerned only with lids made from vacuum-formed sheet plastic. (Sometimes, lids can be of injection moulded plastic, but the production processes are so widely dissimilar that the advantages and restrictions of injection-moulding are quite different).

In the invention, the lid is provided with a ridge, and is provided with with two cuts, one each side of the ridge. When a person squeezes the sides or walls of the ridge together, the cuts start to elongate. The direction in which the cuts start to elongate then can be easily controlled by the person's finger and thumb as he squeezes the ridge. The cuts elongate towards and across the ridge, and the person can easily manipulate and finally remove a tear-out portion of the lid.

The liquid is poured out of the hole left by the tear-out portion into the drinking cups, as required. It is important that the lid retains structural strength during the pouring stage: thus, it is essential not to remove a sector of the rim of the lid, i.e., that part of the lid that snaps over the flange of the container, since that would markedly weaken the lid. In the invention, the hole does not, therefore, quite reach the rim of the lid. Hence, not quite all of the liquid can be poured out. However, when the container is almost empty, the lid can be removed at that time from the container for the purpose of pouring out the last drops.

The lid may be provided with a formed spout, to ease the act of pouring. Naturally, the spout will be in line with (i.e. at the same orientation as) the cuts.

The ridge may be arranged to surround a well that is dimensioned to accept and to grip the drinking cups. With the cups in the well, the container and the cups can be safely carried just with one hand.

A preferred embodiment of the invention will now be described, with reference to the accompanying drawings.

Figure 2:
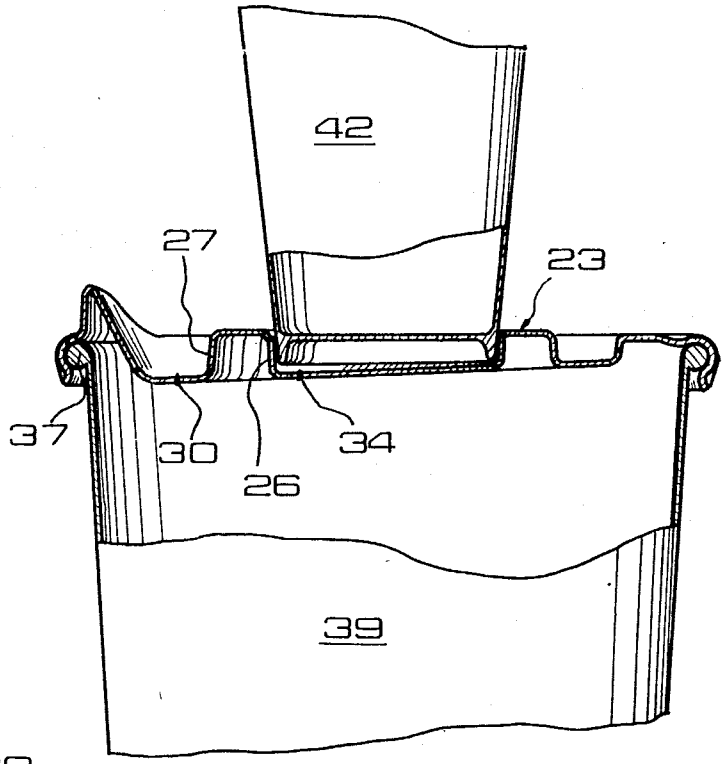
FIG. 2 is a cross-section of the lid of FIG. 1, fitted to a container, and supporting a number of drinking cups.
Figure 1:
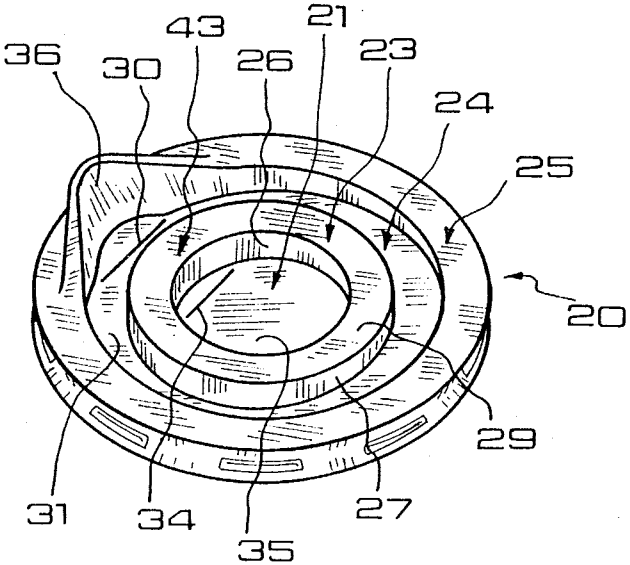
FIG. 1 is an illustrative view of a lid.

The lid 20 includes a well 21, a ridge 23, a trough 24, and a rim 25. All are circular, and concentric. The ridge 23 is formed with an inner-side wall 26 and an outer side wall 27. The ridge 23 also has a top 29.

An outer cut 30 is formed in the bottom 31 of the trough 32. An inner cut 34 is formed in the bottom 35 of the well 21. Both cuts 30,34 are made by a simple shearing operation. (It is a simple everyday operation to shear through a plastic lid at a place on the lid—as in the bottoms 31,35—where the plastic lies in the plane of the lid. It would be very expensive however to cut through the plastic of the side walls 26,27).

The lid 20 also is provided with a spout 36.

In use, the lid 20 is snapped over the flange 37 of a large container 39, which is made in the conventional manner from waxed paper. Drinking cups of the stacking kind, one of which 42 is shown, may be placed in the well 21. The well 21 is dimensioned so that it will grip the cut 42. Thus the assembly of container 39, lid 20, and cups 42 becomes a single unit. The unit is very much easier to carry than a quantity of separate drinking cups.

To pour the drinking liquid into the cups 42, the user removes a removable portion 43 from the lid 20. He places his forefinger and thumb one either side of the ridge 23, i.e., one inside and one outside. He then squeezes his thumb and finger together—an action which causes the walls 26,27 to move together. The action also causes the cuts 30,34 to open.

It might be considered that only the cuts 30,34 are important in defining the removable or tear-out portion 43. However, the ridge 23 plays an important role in controlling and defining the path along which the cuts 30,34 will elongate.

If there were no ridge 23 at all, (i.e. if the material were flat between the cuts) and if the person simply pushed downwards between the cuts, then the cuts would tend to elongate in the same direction as that of the cuts themselves. Thus, it would be very difficult to actually remove a portion of the lid. Even if a hole were made, a flap of the material would inevitably be left dangling inside the container. The flap would act as a valve, and would occasionally plug the hole, and generally would make pouring the liquid an uncontrolled, hazardous, operation.

It is an important feature that the ridge 23 acts as a handle, to permit the tear-out portion to be worked and manipulated, and to be finally separated and removed from the lid.

It might be considered that the function of a handle could be provided if the rib 23 were not continuous. Thus, the "handle" might be thought to possibly consist of a raised button of material between the cuts 30,34. In this case, the bottoms 31,35 of the trough 24 and the well 21 would comprise one continuous flat surface.

Even though an isolated button like that might function as a handle, the manner in which the cuts 30,34 tend to elongate would still be largely uncontrolled. It is a feature of the invention that the ridge 23 is continuous, i.e., that the side walls 26,27 are continuous, in the region between the cuts 30,34. It has been found that when the ridge is squeezed, the cuts 30,34 tear and elongate in a direction which is substantially straight across the ridge. The direction in which the cuts 30,34 elongate is defined and controlled. It becomes very easy to remove the tear-out portion 43, and to remove it without exerting a large force, and without taking more precautions than a person would expect to have to take to avoid spilling the contents of the containers.

The reason why the continuous ridge 23 is so effective may be due to a number of factors. First, the ridge 23 makes the lid 20 very rigid in the vertical direction in the region between the cuts 30,34—much more so than in regions where the lid is simply flat. Therefore the material does not tend to bend and twist as much as it would if it were flat. This rigidity therefore enhances the controllability of the direction of tearing.

The second reason is that the walls 26,27 of the ridge are very thin. This is due to the vacuumforming process, in which the material, prior to forming, is a flat sheet. The part of the material that goes into forming a vertical or nearly vertical wall is that part that lies in the vertical projection of the wall. The material tends not to slip over the forming tools. Hence, the vertical walls are comprised of stretched material, and are therefore thin. The more nearly vertical the wall, and the higher the wall, the thinner it will be. The walls 26,27 of the ridge 23 are therefore thin, and easily able to accept and continue a tear. The top 29 of the ridge 23 of course will not be stretched, but once the cuts have reached the top 29 of the ridge 23, it is an easy matter finally to tear through the top 29.

The bottoms 31,35 of the trough 24 and well 21 are sloping, as may be seen in FIG. 2, so that the walls are not stretched and thinned quite so much at the orientation directly opposite the spout 36. The material that makes up the spout 36 is not thinned very much either, since it is not so nearly vertical as the walls 26,27. Thus, the thinnest part of the material of the lid 20 is in the walls 26,27, at the orientation in line with the spout 36: i.e., directly where it is required for the cuts 30,34 to elongate.

The cuts 30,34 are preferably straight. The tools which shear the cuts are then much easier to make than they would be if the cuts were, for example, curved. However, the outer cut 30 may be curved, so that the cut follows the line of the spout 36. The outer cut 30 might alternatively be provided with cross-cuts (not shown) at or near its ends, for the purpose of directing—even more controllably—the elongation of the cut 30 towards the ridge 23.

Thin sheet polystyrene, of the kind used in making lids, has the property that the material is considerably easier to tear along the "grain" of the material than across the grain. Hence, the lid should be orientated during manufacture such that the cuts 30,34 lie across the grain.

The shearing operation is carried out at a different stage in the vacuum moulding operation, so it is necessary to take steps to ensure that the cuts 30,34 are at the same orientation as the spout 36. However, this is usually no problem.

The cuts 30,34 preferably should be about 2 cm long, i.e., the width of the end of a thumb. The outer wall 27 preferably varies from a height of about 7 mm at the orientation of the spout 36, to a height of about 3 mm opposite the spout 36.

I claim:

1. A lid for a container of liquids, where the lid is vacuum formed in thin sheet plastic;

where the lid includes a depressed well, which is surrounded by a raised ridge, which is in turn surrounded by a depressed trough, which is in turn surrounded by a raised rim;

where the side walls and top of the ridge are of such height and radial width that a person's thumb and forefinger can be easily placed well in contact with the respective side walls, one inside and one outside the ridge;

where two formed cuts are provided in the material of the lid, each disposed alongside the ridge, where one cut is in the well, and the other cut is in the trough; and where the side walls and top of the ridge are continuous and extend circumferentially without interruption at least in the region of the ridge that lies beteen the lengths of the cuts.

2. Lid of claim 1, where the lid is circular, and the well, ridge, trough, and rim each are circular.

3. Lid of claim 2 where the side walls and top of the ridge are continuous and extend circumferentially without interruption all round the circle of the ridge.

4. Lid of claim 2, where the well, ridge, trough, and rim are all concentric.

5. Lid of claim 2, where the bottom of the well is flat and where the top of the ridge is flat;

where the plane of the bottom of the well lies at a small angle to the plane of the top of the ridge, such that the height of the side walls of the ridge varies around the circumference of the ridge;

and where the orientation at which the walls are the highest substantially concides with the orientation at which the said cuts are formed.

6. Lid of claim 5 where the plane of the bottom of the trough is flat and parallel to the plane of the bottom of the well.

7. Lid of claim 5, where the plane of the top of the rim is flat and parallel to the plane of the top of the ridge.

8. Lid of claim 7, where the lid is formed with a spout, at an orientation which substantially coincides with the orientation at which the cuts are formed.

9. Lid of claim 2 where the cuts are straight, parallel and are both symmetrical about the same radius of the lid.

10. Lid of claim 9, where the cuts each are about 2 cm long.

11. Lid of claim 1, where the cuts are straight and parallel.

12. Lid of claim 1, where the cuts are formed by a simple shearing action, substantially no material being removed in forming the cut.

13. An outfit comprising:

a lid as claimed in claim 1;

a large container over which the rim of the said lid is fitted;

at least one smaller drinking cup, which is dimensioned to fit into the well of the said lid, and to be, in substance, gripped thereby.

* * * * *